US005348447A

United States Patent [19]

Redetzke

[11] Patent Number: 5,348,447

[45] Date of Patent: Sep. 20, 1994

[54] IMPROVED FAN HOUSING WITH EASY ACCESS

[75] Inventor: Donovan A. Redetzke, Altoona, Wis.

[73] Assignee: J & D Sales, Eau Claire, Wis.

[21] Appl. No.: 999,146

[22] Filed: Dec. 30, 1992

[51] Int. Cl.[5] ..... F04D 29/64

[52] U.S. Cl. ..... 416/247 R

[58] Field of Search ..... 416/247 R, 247 A; 415/121.2

[56] References Cited

U.S. PATENT DOCUMENTS

| | | | |
|---|---|---|---|
| D. 309,944 | 8/1990 | Chiu | D23/382 |
| 2,017,431 | 10/1935 | Anderson et al. . | |
| 2,259,853 | 10/1941 | Koch . | |
| 2,617,583 | 11/1952 | Kemler | 416/247 R |
| 2,624,504 | 1/1953 | Viewegh | 416/247 R |
| 2,650,021 | 8/1953 | Morrill | 416/121.2 |
| 2,656,974 | 10/1953 | Holstein . | |
| 2,728,519 | 12/1955 | McLarty . | |
| 2,829,819 | 4/1958 | Corwin . | |
| 2,862,652 | 12/1958 | Hoiby et al. . | |
| 2,862,657 | 12/1958 | Copeland et al. . | |
| 3,262,638 | 7/1966 | Militello | 416/247 R |
| 3,347,452 | 10/1967 | Radcliffe . | |
| 3,787,142 | 1/1974 | Dupke | 416/247 R |
| 3,791,333 | 2/1974 | Losch . | |
| 3,963,382 | 6/1976 | Patton | 416/247 R |
| 4,022,548 | 5/1977 | McLarty | 416/247 R |
| 4,222,318 | 9/1980 | Patton et al. . | |
| 4,657,483 | 4/1987 | Bede | 416/247 R |
| 4,657,485 | 4/1987 | Hartwig . | |
| 4,818,183 | 4/1989 | Schaefer . | |
| 4,836,751 | 6/1989 | Liu | 416/247 R |
| 5,002,462 | 3/1991 | Janisse | 416/247 R |
| 5,073,088 | 12/1991 | Peng | 416/247 R |

OTHER PUBLICATIONS

*Agro-Power Galvanized Wall Fans*—1 sheet/double sided.

*Dynavent Farm Equipment, Inc.*—2 sheets/double sided.

*New Generation,* RayDot Incorporated Total Ventilation Systems—1 sheet/double sided.

*When You Need It Now, Grainger Moves More Than Just Air*—1 sheet/1 side.

Dayton Utility Shutter-Mounted Exhaust Fans, Operating Instructions and Parts Manual—4 sheets/1 sided.

*Dayton Guard-Mounted Exhaust Fans,* Operating Instructions and Parts Manual—4 sheets/1 sided.

*Dayton Air Circulator,* Operating Instructions and Parts Manual—6 sheets/1 sided.

*Dayton 20" Whole House Window Fan,* Operating Instructions & Parts Manual—4 sheets/1 sided.

*Dayton 36" Direct-Drive Mobile Air Circulator,* Operating Instructions & Parts Manual—4 sheets/1 sided.

*Dayton Shutter-Mounted Exhaust Fans,* Operating Instructions & Parts Manual—4 sheets/1 sided.

*Primary Examiner*—Edward K. Look

*Assistant Examiner*—Michael S. Lee

*Attorney, Agent, or Firm*—Kinney & Lange

[57] ABSTRACT

A fan housing for allowing air to circulate through a fan having rotating fan blades while serving as a safety guard. The housing includes a circumferential wall located about the fan blades. The wall is shielded to a degree sufficient to inhibit the insertion of fingers or the like into the path of the blades adjacent to the blade path and relatively more open along other parts of the wall. The fan housing also includes front and rear safety panels. The fan housing has separable portions which may be pivotally opened and closed without the use of tools for allowing ready access to the fan unit within the fan housing for cleaning and maintenance.

14 Claims, 8 Drawing Sheets

IMPROVED FAN HOUSING WITH EASY ACCESS

BACKGROUND OF THE INVENTION

This invention relates to a fan housing, particularly to a fan housing for allowing air to circulate through a fan having rotating fan blades while serving as a safety guard for the fan and which allows ready access to the fan for cleaning and maintenance.

In the fan industry there is a need for a fan housing which allows a maximum amount of air flow through the fan with a minimum amount of air flow restrictions, while still providing a safety guard which prevents a human hand, finger or similar object from getting into the path of the fan blade. While accomplishing these performance and safety objectives, the fan housing must also allow ready access to the fan unit within the housing for cleaning and maintenance.

A primary concern of the fan industry is safety. During typical fan operation, fan blades are rotated at high RPM's. If an object such as a human hand or finger comes in contact with the rotating blades, the end result may be a severed appendage or even more severe injury. These rotating fan blades are encased within a fan housing in order to limit access to the fan housing during fan operation. It is preferred that these housings be designed to maximize air flow and safety while minimizing air flow restrictions. In order to accomplish these objectives, a fan housing must be designed such that the rapidly rotating fan blade is out of reach of a human hand, finger, or similar object.

Circulating fans are often installed in industrial or agricultural applications which are notoriously unclean environments. In an agricultural application, circulating fans are typically suspended overhead to provide maximum ventilation and air turnover to livestock. In these harsh environments, objects such as hay, straw, dust, chicken feathers, or other airborne material typically become lodged within the fan housing. Therefor, the fan housing must also allow easy access to the fan unit for cleaning and maintenance.

In the past, fans for these applications have had fan guards which include rear and front substantially open fan guard faces (e.g., screens or wire grids), with closed or nearly closed circumferential side walls. Rear and front fan guard faces have been proposed which will permit a hand, finger, or foot to pass partially therethrough. The circumferential side walls connect the rear and front guard faces to enclose the fan blades. The fan blades are spaced approximately equal distances from the front and back guard faces, with the guard faces being far enough away from the fan blades to prohibit a hand, finger, or foot from reaching the fan blade path.

The circumferential walls of these devices have been limited to walls which are totally or essentially closed. The totally closed circumferential walls typically consist of painted or galvanized sheet metal which keeps objects from coming in contact with the fan blade. Other fans of this type have circumferential walls which are essentially closed and typically consist of parallel wires. Although these totally or essentially closed circumferential walls keep the rapidly rotating fan blade out of reach of the human hand, finger, or similar object, the closed nature of these walls inhibits air flow through the fan.

In these typical fan applications, the rear and front guards are fixedly connected to at least a portion of the circumferential walls. To clean and maintain a fan using these fan safety guards, one must unlock the rear and front guards which are secured together via the circumferential wall. Other fans of this type have their fan guard sections bolted or otherwise fixedly secured together so that tools and excessive handling are required to open the fan guard for cleaning and maintenance.

SUMMARY OF THE INVENTION

The present invention is directed to a fan housing for allowing air to circulate through a fan having rotating fan blades which extend radially from a center point, with the fan housing serving as a safety guard. The inventive fan housing allows a maximum amount of air to flow through the fan with a minimum amount of air flow restrictions, while providing a safety guard which is intended to inhibit a human hand, finger, or similar object from getting into the path of the rotating fan blades. This is accomplished by having a circumferential wall located about the fan blades wherein the wall is shielded to a degree sufficient to inhibit the insertion of fingers or the like into the path of the blades adjacent to the blade path and is relatively more open along other parts of the wall. Preferably, the fan guard has a front guard and a rear guard. The front and rear guards are open enough so that a human hand, finger or similar object is allowed to pass partially therethrough, but the front and rear guards are spaced far enough away from the path of the fan blades such that the human hand, finger or similar object will not come in contact with the rotating fan blades.

In one preferred embodiment, the device includes a fan housing having a circumferential frame side wall and a front panel for allowing air to circulate through a fan mounted therein which has rotating fan blades, with the front panel also serving as a safety guard. The circumferential frame side wall is located about the fan blades and is shielded to a degree sufficient to inhibit the insertion of fingers or the like into the path of the blades adjacent to the blade path, while the circumferential frame side wall is relatively more open along other parts of the wall. The front panel and at least part of the side wall may be opened and closed without the use of tools, allowing for easy access to the fan therein for cleaning and maintenance purposes. When the front panel is in the open position, at least one pin acts as a hinge, and when the front panel is in a closed position, at least one pin secures the front panel and part of the side wall to the rest of the fan housing.

BRIEF DESCRIPTION OF THE DRAWINGS

The invention will be further described with reference to the accompanying drawings where like numbers refer to like parts in several views and wherein.

While the above identified drawing figures set forth several preferred embodiments, other embodiments of the present invention are also contemplated, as noted in the discussion. In all cases, this disclosure presents illustrated embodiments of the present invention by way of representation and not limitation. It should be understood that numerous other modifications and embodiments can be devised by those skilled in the art which fall within the scope and spirit of the principles of this invention. It should be noted that the figures have not been drawn to scale as it has been necessary to enlarge certain portions for clarity.

DETAILED DESCRIPTION OF THE PREFERRED EMBODIMENTS

Figure 1:
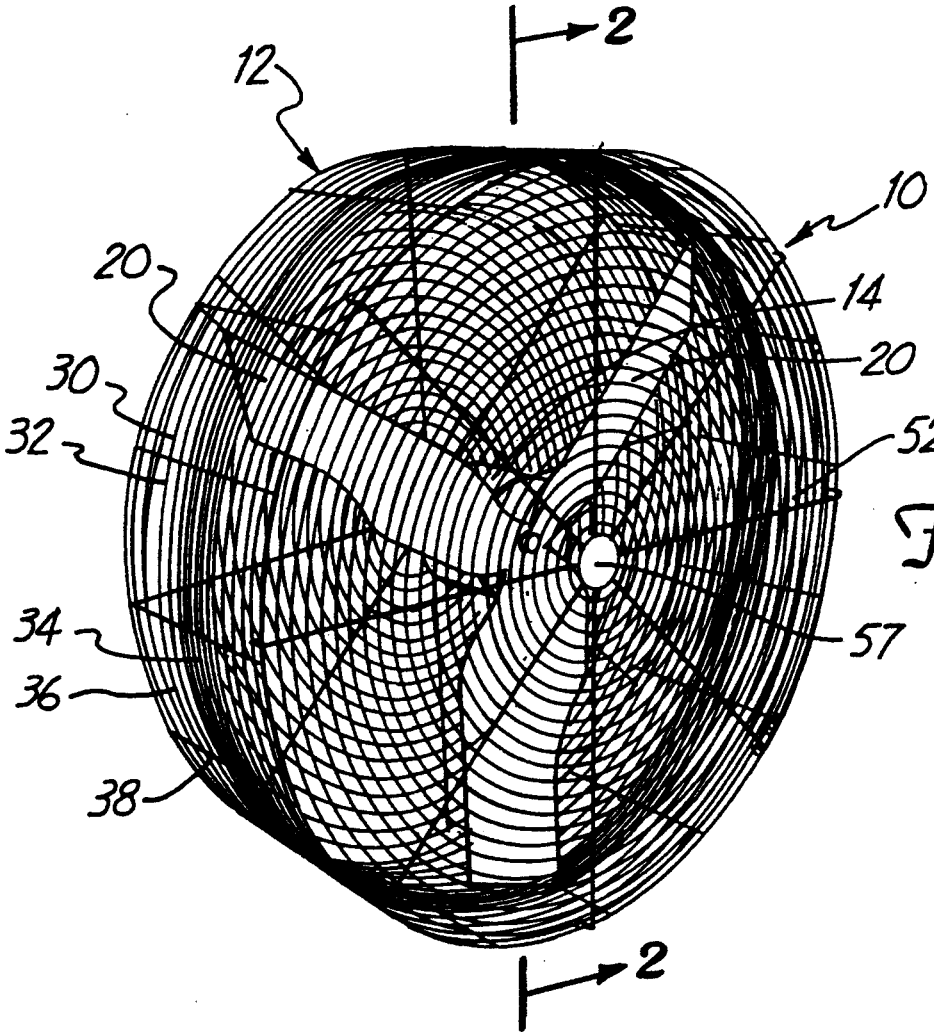
FIG. 1 is a view in perspective of a fan showing the present fan housing invention.
Figure 2:
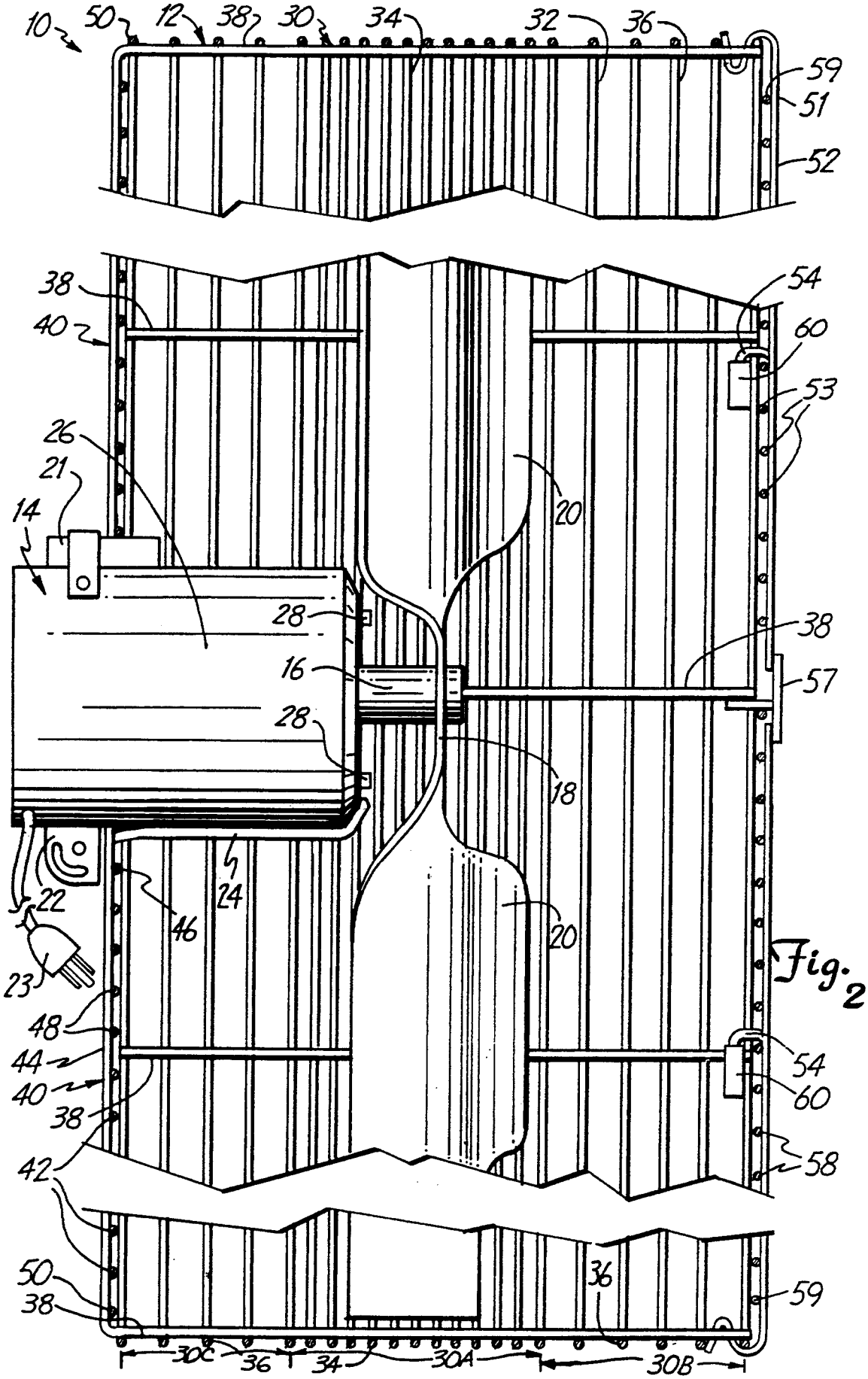
FIG. 2 is an enlarged sectional view as taken along line 2—2 of FIG. 1.

In FIG. 1, a fan is shown generally at 10, with the fan housing of this invention being shown generally at 12. As seen in FIG. 2, a fan motor 14, a motor shaft 16, an impeller blade 18 and fan blades 20 are mounted within the fan housing 12. The fan motor 14 extends through the fan housing 12. A starting capacitor 21, fan mounting plate 22, and electric power source connector 23 are attached to the fan motor 14 outside of the fan housing 12. The fan motor 14 has a motor casing 26. On a back side thereof, the fan housing 12 includes a plurality of motor support angles 24 (only one of which is shown) which support the fan motor 14 by attaching to the fan motor casing 26 with support bolts 28.

The fan 10 is supported by attaching the fan 10 to any typical support structure with a bolted connection to the fan mounting plate 22. Typical mounting applications include mounting the fan 10 on a pedestal or hanging the fan 10 from a ceiling or rafter.

The fan motor 14 is connected to the motor shaft 16 which in turn is connected to the impeller blade 18. The fan 10 is powered through the power source connector 23 which supplies power to the fan motor 14. In one embodiment, a starting capacitor 21 is used to start the fan motor 14. The fan motor 14 converts electrical energy to mechanical energy which rotates the motor shaft 16 and impeller blades 18 which are attached to the motor shaft 16. Therefor, the fan blades 20 also rotate since they are attached to the impeller blade 18. The system results in typical fan operation, whereby the fan blades 20 are rotated at high RPM's. The rotating fan blades 20 are encased within the fan housing 12.

The fan housing 12 is designed to maximize air flow and safety while minimizing air flow restrictions. The fan housing 12 of the invention generally includes a circumferential wall 30 comprised of circumferential wires 32 spaced parallel to each other. The wires may be made of metal, molded plastic, or a similar material. The circumferential wall 30 has a shielded area 30A (shielded to a degree sufficient to inhibit the insertion of fingers or the like into the path of the blades) adjacent to the path of the rotating fan blades 20, and relatively more open areas 30B and 30C along other parts of the circumferential wall 30. In one preferred embodiment, this is accomplished by the spacing of the adjacent circumferential wires 32. The circumferential wires 32 include spaced circumferential wires 34 (in area 30A) and more openly spaced circumferential wires 36 (in areas 30B and 30C). The spaced circumferential wires 34 of area 30A are located adjacent the rotating fan blade 20 path and the more openly spaced circumferential wires 36 of areas 30B and 30C are located along other parts of the circumferential wall 30.

The spaced circumferential wires 34 are spaced to serve as a safety guard to inhibit a human hand, finger or similar object from getting into the path of the rotating fan blade 20. Although this is one 10 preferred embodiment of the invention, alternatively the spaced circumferential wires 34 may be located next to each other or the circumferential wall 30 at area 30A may be comprised of a solid wall consisting of sheet metal, plastic, or other similar solid material.

The more openly spaced circumferential wires 36 are spaced to allow maximum air flow through the fan housing 12 while still serving as a safety guard such that a human hand, finger or similar object is allowed to pass only partially therethrough. The more openly spaced circumferential wires 36 are spaced apart wider than the spacing of the spaced circumferential wires 34. This allows more air to get into the fan blades 20 from the rear of the circumferential wall 30 (area 30C) and allows wider dispersion as air flows through the fan blades 20 and out a front of the fan 10 including the front of the circumferential wall 30 (area 30B).

The parallel spaced circumferential wires 32 of the circumferential wall 30 are kept in place by a plurality of support wires 38 which are spaced equidistantly around the circumferential wall 30 and are generally parallel to the motor shaft 16, as shown in FIGS. 1 and 2. In one embodiment the support wires 38 are securely attached to each of the circumferential wires 32 of the circumferential wall 30 using spot welds.

Figure 3:
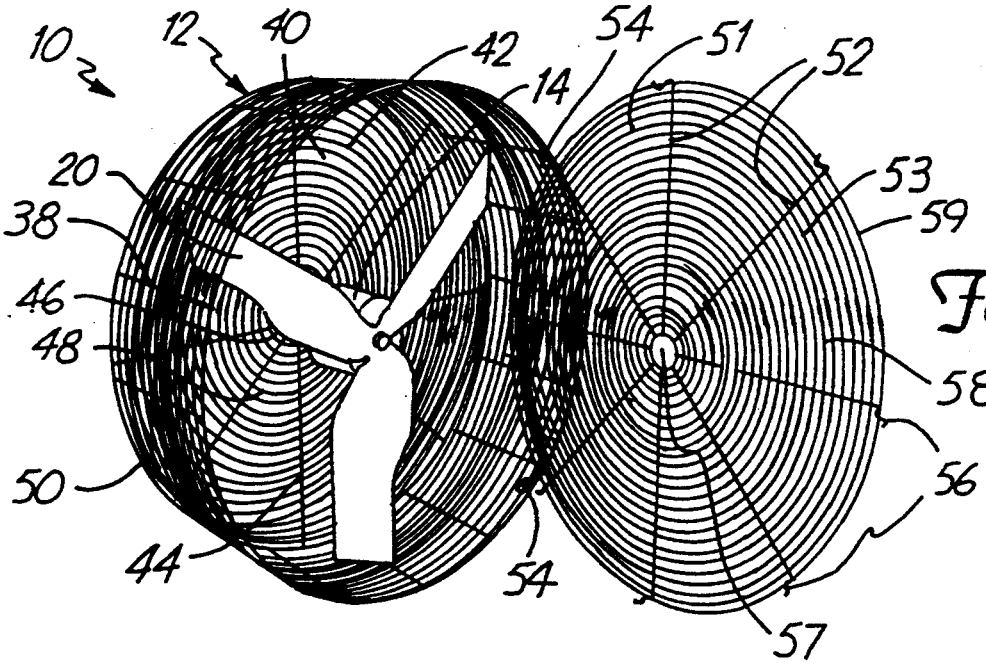
FIG. 3 is a front perspective view of the inventive fan housing with the front panel open.

A rear panel 40 is securely attached to the circumferential wall 30 as shown in FIGS. 2 and 3. The rear panel 40 includes concentric wires 42 and radial support wires 44. The concentric wires 42 include an inner circular concentric wire 46, intermediate circular concentric wires 48 and an outer circular concentric wire 50. The outer circular concentric wire 50 is the 10 outside rear circumferential wire 32 of the circumferential wall 30. The inner circular concentric wire 46, intermediate circular concentric wires 48, and outer circular concentric wire 50 are aligned and held in place by a plurality of radial support wires 44. In one embodiment, each of the radial support wires 44 are attached to the concentric wires 42 using a spot weld. The radial support wires 44 extend radially from the inner circular concentric wire 46 to the outer circular concentric wire 50. Several extended radial support wires 44 extend beyond the inner circular concentric wire 46 to provide the motor support angles 24 which support the fan motor 14. These extended radial support wires 44 also continue on to form the support wires 38 located about the circumferential wall 30, thereby securely attaching the rear panel 40 to the circumferential wall 30.

The fan 10 also includes a front panel 51 as shown in FIGS. 2 and 3. The front panel 51 includes radial support wires 52, concentric wires 53, hinge pins 54, fastening pins 56, and center plate 57. The concentric wires 53 include intermediate circular concentric wires 58 and outer circular concentric wire 59. The concentric wires 53 are equidistantly spaced apart from the center plate 57 to the outer circular concentric wire 59 and each wire is aligned by being securely attached using a spot weld to the radial support wires 52. The radial support wires 52 extend beyond the outer circular concentric wire 59 to form either a hinge pin 54 or a fastening pin 56. Each hinge pin 54 is pivotally retained in a tube 60 fixed to the circumferential wall 30 which defines a hinge for opening and closing the front panel 51 as shown in FIG. 3. When the front panel 51 is in the closed position, the fastening pins 56 snap fit around the outer circumferential wire 32 of the circumferential wall 30 for securing the front panel 52 to the circumferential wall 30. The fastening pins 56 may be manually manipulated to engage and disengage from the circumferential wires 32, so that the opening and closing of the front panel 52 is accomplished without the use of tools.

In one preferred embodiment, the fan housing 12 includes a circumferential wall 30 and front panel 51 for allowing air to circulate through a fan 10 mounted therein which has rotating fan blades 20, with the front panel 51 serving as a safety guard. The fan housing 12 comprises a circumferential wall 30 located about the fan blades 20 wherein the wall is shielded (area 30A) adjacent to the fan blade 20 path and relatively more open (areas 30B and 30C) along other parts of the circumferential wall 30. This allows a maximum amount of air to flow through the fan 10 with a minimum amount of air flow restrictions, while providing an effective safety guard which acts to inhibit a human hand, finger, or similar object from getting into the path of the rotating fan blades 20. The front panel 51 may be opened and closed without the use of tools, thereby allowing easy access to the fan 10 for cleaning and maintenance purposes. When the front panel 52 is in the open position, at least one hinge pin 54 acts as a hinge, and when the front panel 52 is in the closed position, at least one hinge pin 54 secures the front panel 52 to the circumferential wall 30. As shown in FIG. 3, in a preferred embodiment two hinge pins 54 are aligned coaxially to provide a pivot axis between the side wall 30 and front panel 52.

Other embodiments of the invention are also contemplated. Also, the diameter of the fan blade paths may vary, for example, typical fan sizes include 12 inch, 20 inch, 24 inch, and 36 inch.

The fan housing may be hinged for access at various useful locations other than the front panel. These locations include being hinged along the rear panel or anywhere along the circumferential side wall.

Figure 4A:
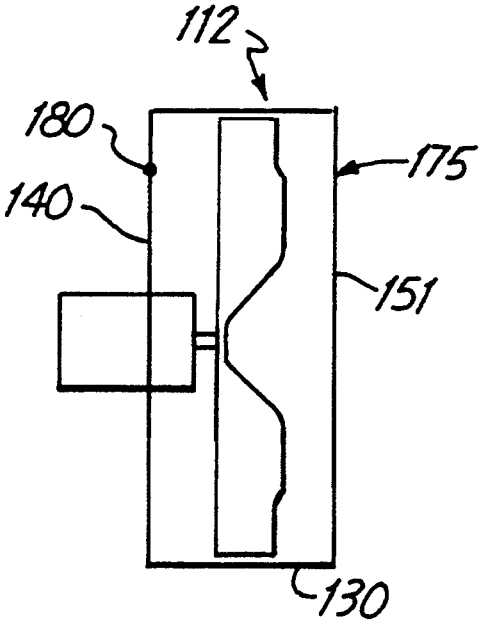
FIG. 4*a* is a simplified diagram of a rear hinged fan housing in the closed position.
Figure 4B:
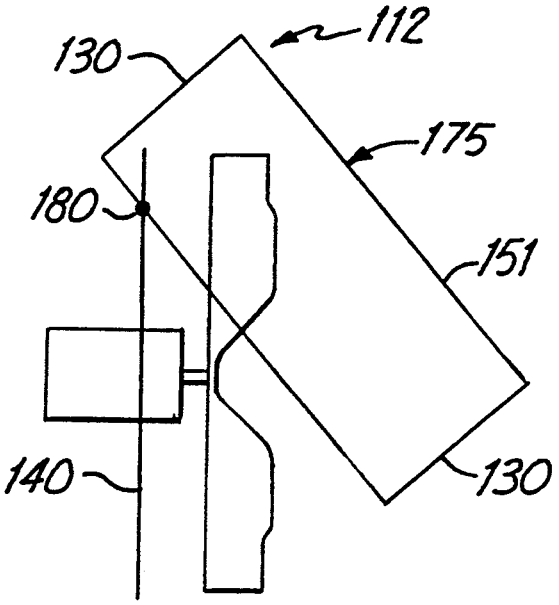
FIG. 4*b* is a simplified diagram of a rear hinged fan housing in the open position.

FIGS. 4*a* and 4*b* illustrate an alternative embodiment where the fan housing is hinged at the rear panel instead of the front panel. FIG. 4*a* shows a fan housing 112 with a rear panel 140 and a hinged front panel assembly 175 in a closed position. FIG. 4*b* shows the fan with the front panel assembly 175 in an open position relative to the rear panel 140. In this arrangement, the front panel 151 is securely attached to the fan housing circumferential side wall 130. When accessing the fan unit, the front panel 151 and side wall 130 are pivoted as a unit (front panel assembly 175) about a pivotal axis 180 located along the hinges between the rear panel 140 and the side wall 130. The pivotal mounting and latching mechanisms for the inventive embodiment of FIGS. 4*a* and 4*b* are the same as those shown in FIGS. 1–3.

Figure 5A:
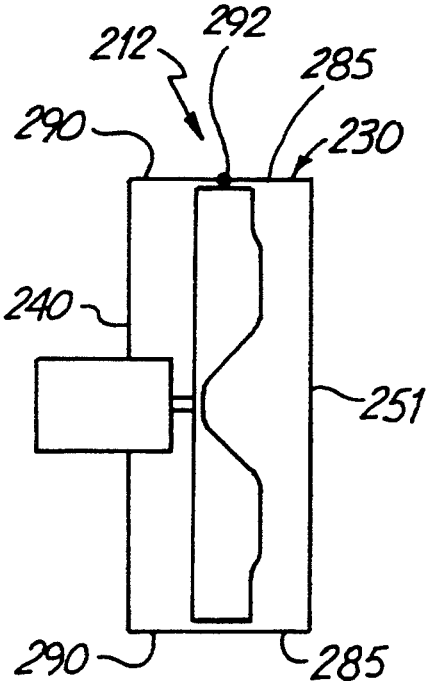
FIG. 5*a* is a simplified diagram of a center hinged fan housing in the closed position.
Figure 5B:
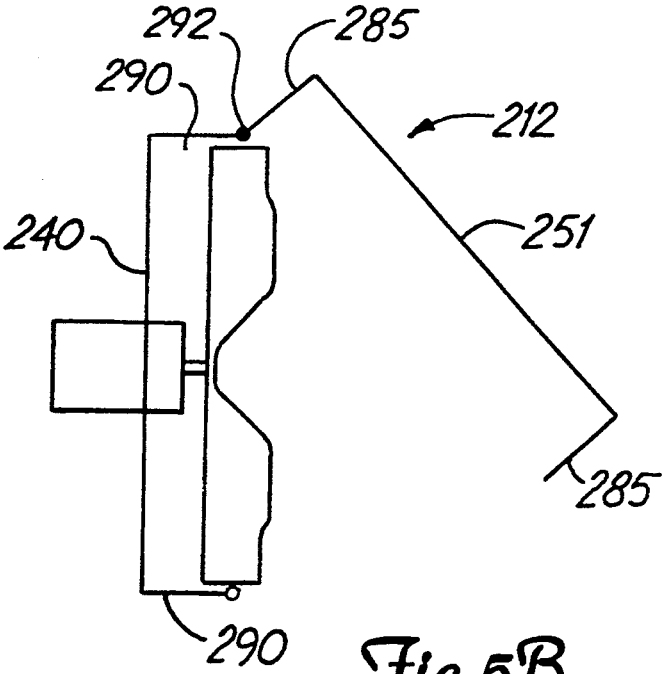
FIG. 5*b* is a simplified diagram of a center hinged fan housing in the open position.

FIGS. 5*a* and 5*b* illustrate an alternative embodiment where a fan housing 212 is hinged adjacent the center of its circumferential side wall 230. In this embodiment, a front panel 251 is securely attached to a front portion 285 of the circumferential side wall 230, and a rear panel 240 is securely attached to a rear portion 290 of the circumferential side wall 230. FIG. 5*a* shows the fan housing 212 in a closed position. FIG. 5*b* shows the fan housing in an open position to permit access to the fan unit. With the arrangement shown, the front panel 251 and the front portion 285 of the side wall 230 are hinged to rotate along a pivotal axis 292 relative to the rear panel 240 and rear portion 290 of the side wall 230. As before, manually manipulatable fastening pins are spaced about the separable portions of the side wall 230, and the pivot axis between fan housing portions is defined by one or more pivot pins.

Figure 6A:
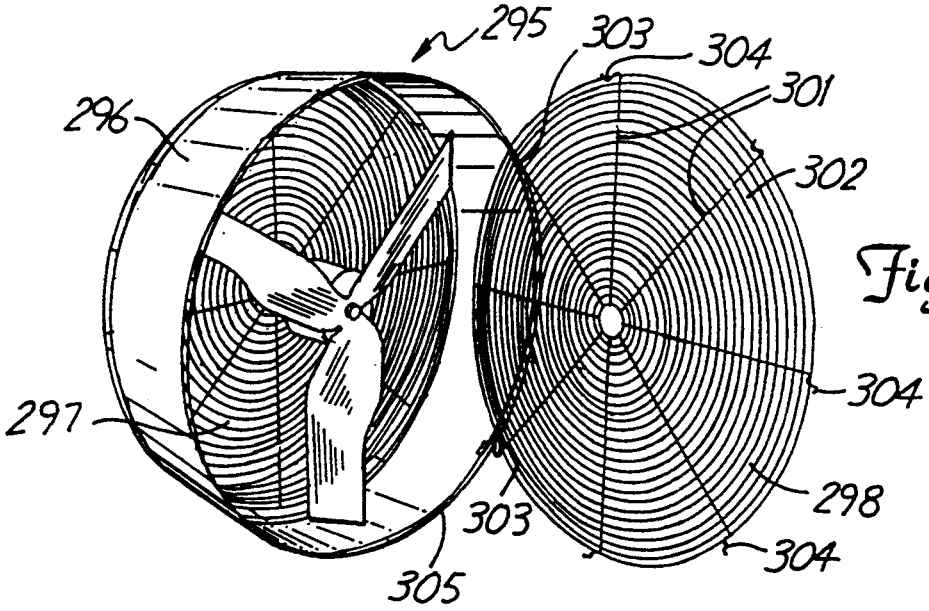
FIG. 6*a* is a front perspective view of an alternative embodiment of the inventive fan housing, with its front panel open.
Figure 6B:
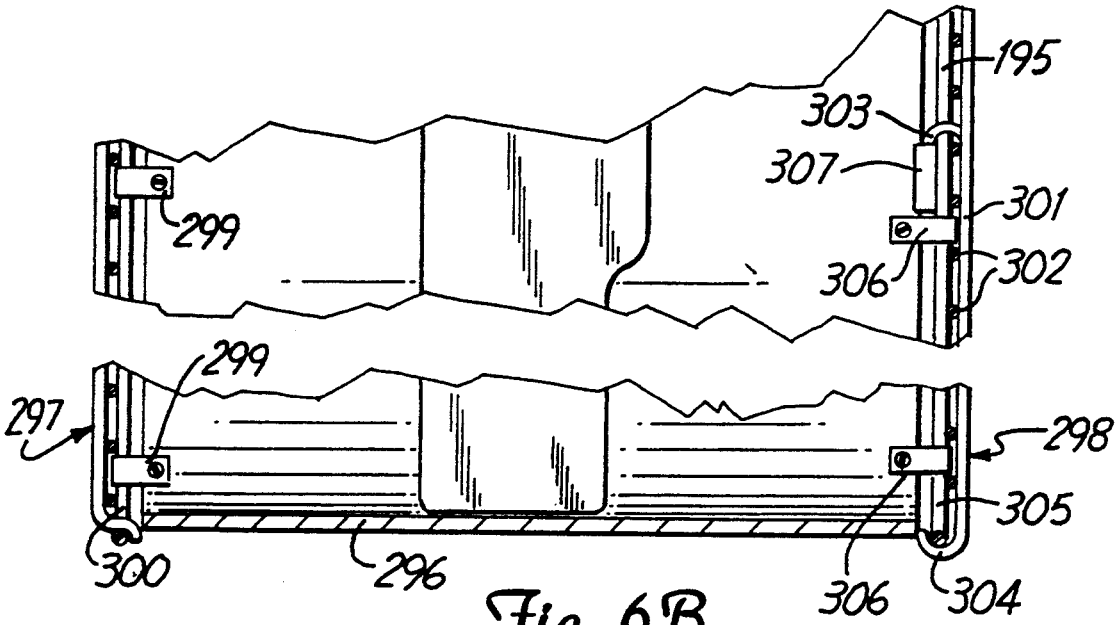
FIG. 6*b* is an enlarged partial sectional view of a portion of the fan housing of FIG. 6*a*.
Figure 7A:
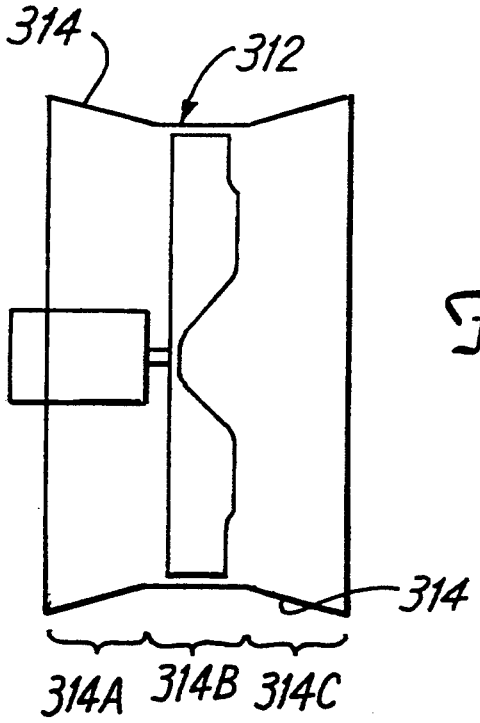
FIG. 7*a* is an simplified diagram of an alternative fan housing showing an alternative shape for the cylindrical wall.
Figure 7B:
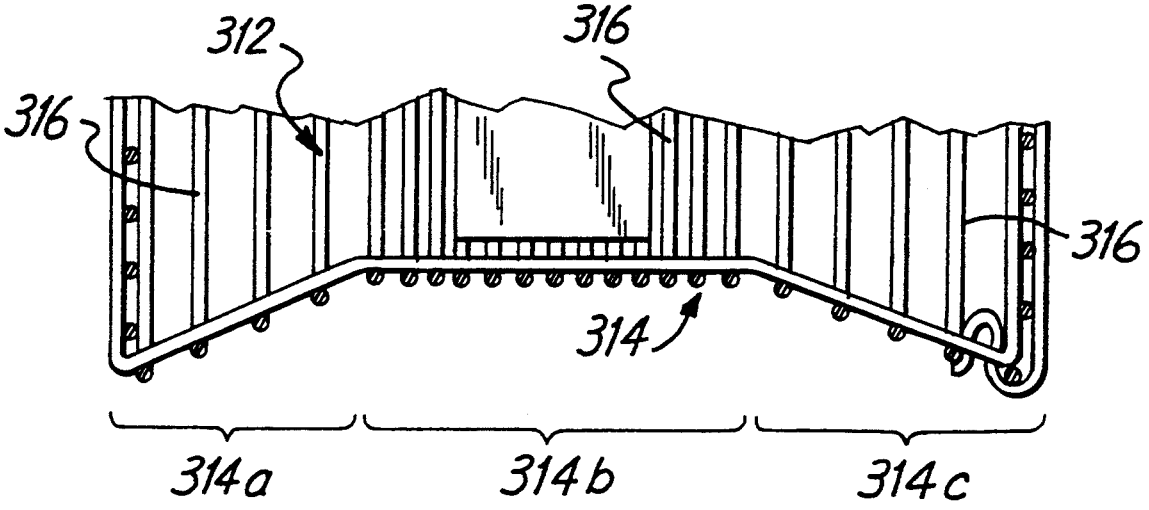
FIG. 7*b* is an enlarged partial sectional view of a portion of the fan housing of FIG. 7*a*.
Figure 8A:
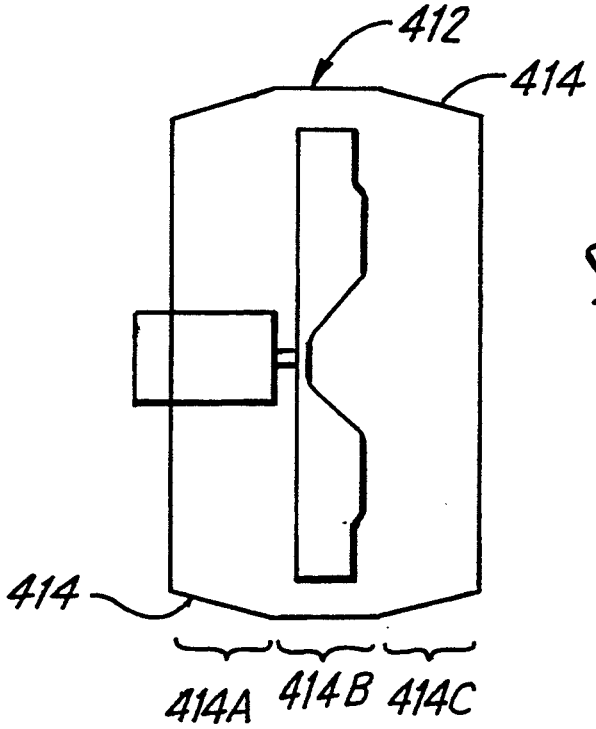
FIG. 8*a* is a an amplified diagram of an alternative fan housing showing an alternative shaped fan housing.
Figure 8B:
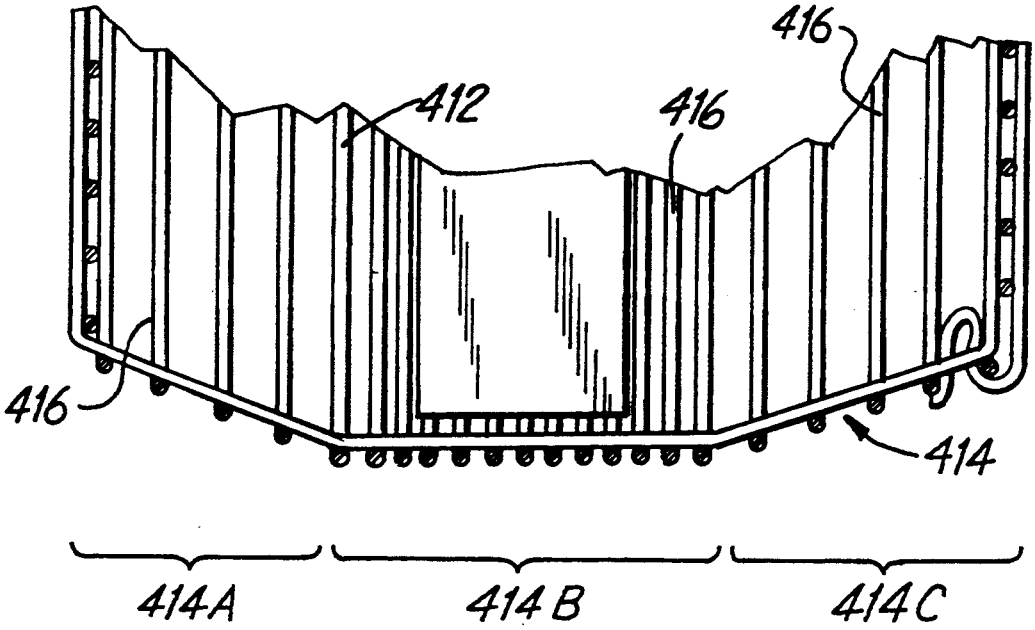
FIG. 8*b* is an enlarged partial sectional view of a portion of the fan housing of FIG. 8*a*.
Figure 9A:
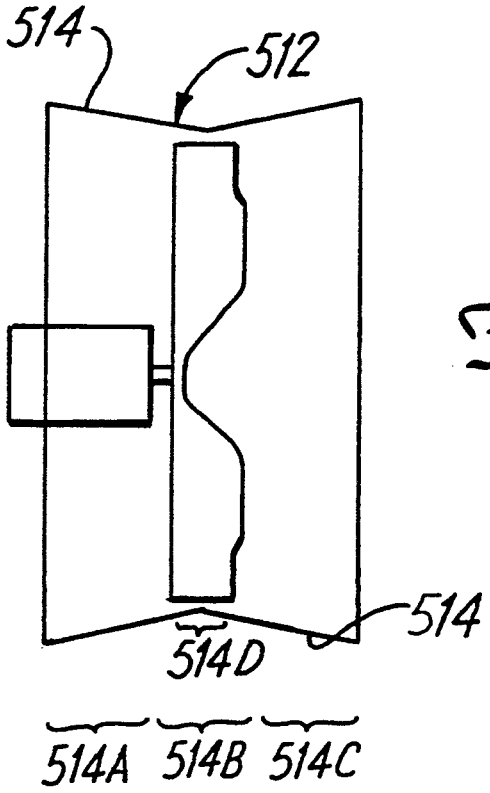
FIG. 9*a* is an amplified diagram of an alternative fan housing showing an alternative shape for the cylindrical wall.
Figure 9B:
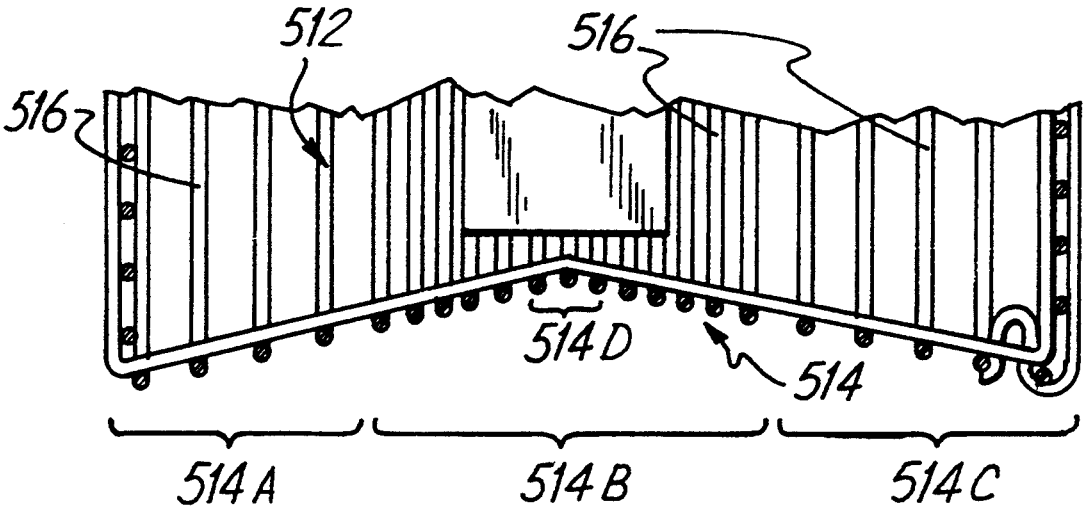
FIG. 9*b* is an enlarged partial sectional view of a portion of the fan housing of FIG. 9*a*.
Figure 10A:
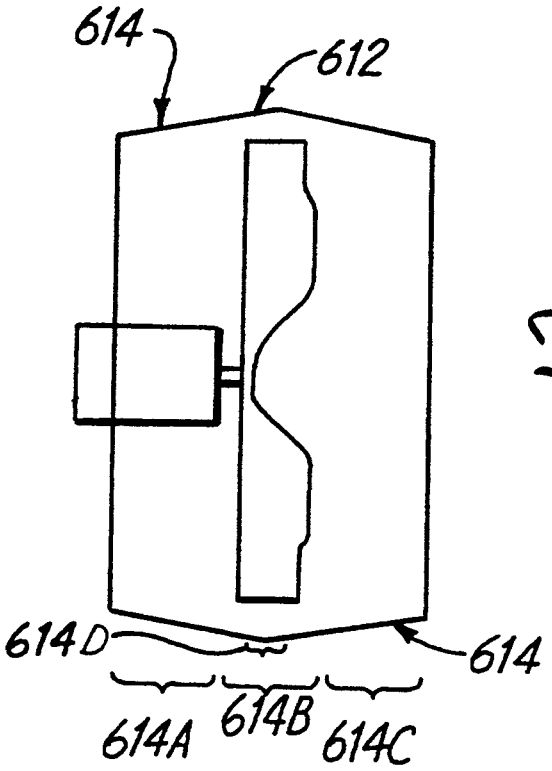
FIG. 10*a* is an amplified diagram of an alternative fan housing showing an alternative shape for the cylindrical wall.
Figure 10B:
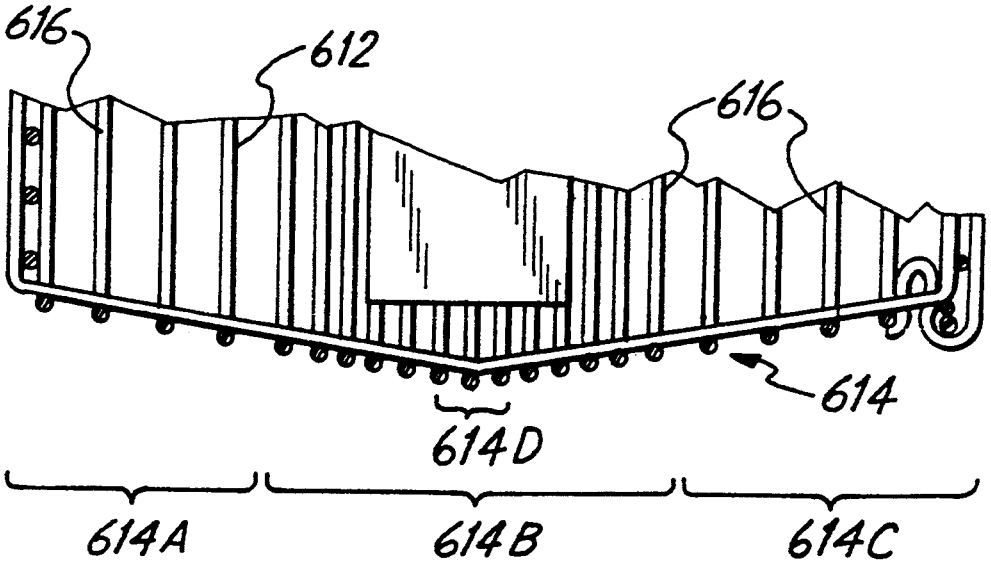
FIG. 10*b* is an enlarged partial sectional view of a portion of the fan housing of FIG. 10.

FIGS. 6*a* and 6*b* illustrate an alternative embodiment. This embodiment is otherwise the same as the fan housing illustrated in FIGS. 1, 2 and 3, except that the circumferential wall is formed from a solid panel or sheet of material (or from circumferential wires having no spacing therebetween). This form of fan housing is shown by illustration in FIG. 6*a* wherein a fan housing 295 has a solid circumferential wall 296. Thus, air flows through the fan housing 295 only via its rear panel 297 and front panel 298. The rear panel 297 is formed similarly to the rear panel 40 illustrated in FIGS. 1–3, having a plurality of concentric wires and associated radial support wires. The rear panel 297 is mounted to the concentric wall 296 by suitable means, such as, for example, a plurality of mounting clips 299 secured between an outermost concentric wire 300 on the rear panel 297 and the concentric wall 296.

The front panel 298 is adapted to be easily opened in the same manner as the front panel 51 shown in FIGS. 1–3. The front panel 298 includes radial support wire 301, concentric wires 302, hinge pins 303, and fastening pins 304. A single concentric wire 305 is secured to a front edge of the concentric wall 296 by suitable means, such as clips 306. Radial support wires 301 extend beyond the outermost concentric wire 302 to form either a hinge pin 303 or a fastening pin 304. Each hinge pin 303 is pivotally retained in a tube 307 fixed either to the concentric wire 305 or directly to the circumferential wall 296, thus defining a hinge for opening and closing the front panel 298 as illustrated in FIG. 6*a*. When the front panel 298 is in its closed position, the fastening pins 304 snap-fit around the circumferential wire 305 for securing the front panel 298 to this circumferential wall 296. The fastening pins 304 may be manually manipulated to engage and disengage from the circumferential wire 305, so that the opening and closing of the front panel 298 is accomplished without the use of tools. Although a concentric wire 305 is illustrated in FIGS. 6*a* and 6*b*, it is contemplated that the front panel may be closed by simple engagement with the circumferential wall 296, so long as the closure is sufficient to prevent inadvertent opening of the front panel 298, but allows opening thereof without the use of tools.

The diameter of the circumferential sidewall may not be uniform along the entire side wall and may vary in any useful way. FIGS. *7a* and *7b* illustrate an alternate embodiment where a fan housing 312 has a circumferential wall 314 with side wall areas 314*a*, 314*b* and 314*c*. Preferably, the area 314*b* of the circumferential wall 314 includes parallel spaced circumferential wires while the areas 314*a* and 314*c* have circumferential wires which are spaced farther apart from one another. Such circumferential wires are shown as wires 316 in FIG. *7b*. The wires 316 in area 314*b* have the same circumferential side wall diameter while the wires 316 in areas 314*a* and 314*c* have larger circumferential side wall diameters. As shown, the diameter of the circumferential side wall gradually increases through each of the areas 314*a* and 314*c*. This design is intended to further maximize air flow through the fan housing 312.

FIGS. *8a* and *8b* illustrate an alternative embodiment where a fan housing 412 has a circumferential wall 414 with side wall areas 414*a*, 414*b* and 414*c*. Preferably, the area 414*b* of the circumferential wall 414 includes parallel spaced circumferential wires while the areas 414*a* and 414*c* have circumferential wires which are spaced farther apart from one another. These circumferential wires are illustrated as wires 416 in FIG. *8b*. The wires 416 in area 414*b* have the same circumferential side wall diameter, while the wires 416 in areas 414*a* and 414*c* have smaller circumferential side wall diameters. As shown, the diameter of the circumferential side wall gradually decreases through each of the areas 414*a* and 414*c*. This design is intended to achieve a more efficient air flow through the fan housing 412 or result in more efficient use of space in installations where space is limited.

FIGS. *9a* and *9b* illustrate an alternate embodiment where a fan housing 512 has a circumferential wall 514 with side wall areas 514*a*, 514*b* and 514*c*. Preferably, the area 514*b* of the circumferential wall 514 includes parallel spaced circumferential wires while the areas 514*a* and 514*c* have circumferential wires which are spaced farther apart from one another. Such circumferential wires are shown as wires 516 in FIG. *9b*. The area 514*b* also includes a center portion 514*d*. As shown, the circumferential wall 514 diameter gradually increases from a center portion 514*d* through the remaining areas of 514*b*, and through each of the areas 514*a* and 514*c*.

FIGS. *10a* and *10b* illustrate an alternate embodiment where a fan housing 612 has a circumferential wall 614 with side wall areas 614*a*, 614*b* and 614*c*. Preferably, the area 614*b* of the circumferential wall 614 includes parallel spaced circumferential wires while the areas 614*a* and 614*c* have circumferential wires which are spaced farther apart from one another. These circumferential wires are illustrated as wires 616 in FIG. *10b*. The side wall area 614*b* includes a center portion 614*d*. As shown, the diameter of the circumferential wall 614 decreases from the center portion 614*d* through the remaining areas of 614*b*, and through each of the areas 614*a* and 614*c*.

It is recognized that any hinge arrangement may be used where the pivotal axis of the hinge is aligned to allow a portion of the fan housing to rotate about that axis. Thus, for example, the fan housing access arrangement illustrated in FIGS. 1–6*b* are applicable to any of the alternative fan housing shape configurations illustrated in FIGS. *7a–10b*. In all of the examples above, the fan assembly within the fan housing may be accessed without the use of tools because of the easy opening and closing feature.

Although the present invention has been described with reference to preferred embodiments, workers skilled in the art will recognize that changes may be made in form and detail without departing from the spirit and scope of the invention.

What is claimed is:

1. A fan housing for allowing air to circulate through a fan having rotating fan blades which extend radially from a center point, the rotating fan blades forming a blade path, the housing serving as a safety guard, comprising:

a circumferential wall located about the fan blades wherein the wall has a relatively open part and a relatively more open part, the relatively open part being located adjacent the fan blades and shielded to a degree sufficient to inhibit the insertion of fingers or the like into the path of the blades and, the relatively more open part being located along other parts of the wall not adjacent the blade path.

2. The fan housing of claim 1 wherein the circumferential wall includes a plurality of circumferential wires.

3. The fan housing of claim 2 wherein the circumferential wires are spaced parallel to each other adjacent the blade path, and wherein the circumferential wires which are not adjacent the blade path are spaced parallel and farther apart.

4. The fan housing of claim 2 wherein the circumferential wires are spaced parallel to each other.

5. The fan housing of claim 4 wherein the parallel spaced circumferential wires are closely spaced to a degree sufficient to inhibit the insertion of fingers radially from the fan blade path.

6. The fan housing of claim 1 wherein the fan housing includes a front panel for preventing a hand, finger or similar object from reaching the path of the fan blades.

7. The fan housing of claim 6 further comprising means for opening and closing the front panel without the use of tools.

8. The fan housing of claim 6 wherein the shielded portion of the circumferential wall adjacent the path of the blades has a first diameter and the other parts of the wall have a diameter different than the first diameter.

9. The fan housing of claim 6 wherein that portion of the circumferential wall which is shielded adjacent the path of the fan blades has a first diameter, and wherein the other parts of the wall include at least one wall portion adjacent the shielded portion, with the one wall portion gradually increasing in diameter from the first diameter adjacent the shielded portion to a second larger diameter spaced therefrom.

10. The fan housing of claim 6 wherein that portion of circumferential wall which is shielded adjacent the path of the fan blades has a first diameter, and wherein the other parts of the wall include at least one wall portion adjacent the shielded portion, with the one wall portion gradually decreasing in diameter from the first diameter adjacent the shielded portion to a second smaller diameter spaced therefrom.

11. The fan housing of claim 6 wherein that portion of circumferential wall which is shielded adjacent the path of the fan blades has a first diameter near its center, and wherein the other parts of the wall include at least one wall portion adjacent the shielded portion, with the remaining area of the shielded portion and one wall portion gradually increasing in diameter from the first diameter adjacent the center of the shielded portion to a second larger diameter spaced therefrom.

12. The fan housing of claim 6 wherein that portion of circumferential wall which is shielded adjacent the path of fan blades has a first diameter near its center, and wherein the other parts of the wall include at least one wall portion adjacent the shielded portion, with the remaining area of the shielded portion and one wall portion gradually decreasing in diameter from the first diameter adjacent the center of the shielded portion to a second smaller diameter spaced therefrom.

13. An improved fan housing having a frame side wall and a front panel for allowing air to circulate through a fan mounted therein which had rotating fan blades, the rotating fan blades forming a blade path, the front panel serving as a safety guard, the improved housing comprising:

a circumferential side wall located about the fan blades wherein the wall has a relatively open part and a relatively more open part, the relatively open part being located adjacent the fan blades and shielded to a degree sufficient to inhibit the insertion of fingers or the like into the path of the blades and, the relatively more open part being located along other parts of the wall not adjacent the blade path; and means for opening and closing the front panel without the use of tools having in an open position at least one pin integral with the fan housing which acts as a hinge pin, and having in a closed position at least one pin integral with the fan housing which secures the front door to the side wall.

14. A fan housing for allowing air to circulate through a fan having rotating fan blades which extend radially from a center point, the rotating fan blades forming a blade path, the housing serving as a safety guard, comprising:

a circumferential wall located about the fan blades, the wall being formed from a plurality of generally parallel circumferential wires, the wall having a relatively open central part and a first relatively more open end part on one side of the central part and a second relatively open end part on the other side of the central part, the relatively open part being located adjacent the fan blades and shielded to a degree sufficient to inhibit the insertion of fingers or the like into the path of the blades, the relatively more open end parts having a first diameter, and the relatively more open part generally parallel circumferential wires being of a different diameter than the relatively open central part;

a front panel mounted on the circumferential wall for allowing air to circulate through the fan while serving as a safety guard;

a rear panel mounted on the circumferential wall for allowing air to circulate through the fan while serving as a safety guard;

means for opening and closing the front panel without the use of tools having in an open position at least one pin integral with the fan housing which acts as a hinge pin, and having in a closed position at least one pin integral with the fan housing which secures the front panel to the circumferential wall; and support means for supporting a fan motor from the fan housing.

* * * * *